US005312153A

United States Patent [19]

Lin

[11] Patent Number: 5,312,153

[45] Date of Patent: May 17, 1994

[54] RECLINE LIFT WALL HUGGER CHAIR

[75] Inventor: Jhy-hong Lin, Milwaukee, Wis.

[73] Assignee: Ortho-Kinetics, Inc., Waukesha, Wis.

[21] Appl. No.: 557,395

[22] Filed: Jul. 23, 1990

[51] Int. Cl.[5] ..... A47C 1/02

[52] U.S. Cl. ..... 297/89; 297/68; 297/DIG. 10

[58] Field of Search ..... 297/DIG. 10, 89, 88, 297/68, 345

[56] References Cited

U.S. PATENT DOCUMENTS

| | | | |
|---|---|---|---|
| 3,874,724 | 4/1975 | Ré | 297/88 |
| 4,216,992 | 8/1980 | Crum | 297/89 X |
| 4,226,468 | 10/1980 | Johnson | 297/68 X |
| 4,244,620 | 1/1981 | Harrison et al. | 297/89 X |
| 4,247,146 | 1/1981 | Cycowicz et al. | 297/89 X |
| 4,365,836 | 12/1982 | Jackson et al. | 297/68 X |
| 4,878,710 | 11/1989 | Tacker | 297/68 |
| 4,904,019 | 2/1990 | May | 297/68 X |
| 4,909,569 | 3/1990 | Gaffney | 297/DIG. 10 X |
| 4,946,222 | 8/1990 | Matson | 297/DIG. 10 X |
| 4,993,777 | 2/1991 | La Pointe | 297/DIG. 10 X |
| 5,024,486 | 6/1991 | Avel | 297/DIG. 10 X |

OTHER PUBLICATIONS

*Kinematics & Linkage Design,* Allen S. Hall, Jr. 1961, pp. 1-10.

*Primary Examiner*—Jose V. Chen

*Attorney, Agent, or Firm*—Ryan, Kees & Hohenfeldt

[57] ABSTRACT

A recline lift chair operates between an upright position and a reclined position under power such that the backrest moves away from an adjacent wall. The chair comprises a base to which is pivotally connected a lift mechanism. The lift mechanism is moved between an upright position and a lift position by a power actuator pivotally secured between the base and the lift mechanism. Pivotally supported on the lift mechanism is a recliner mechanism that includes a pair of four-bar linkages to which the seat and backrest are fastened. The power actuator acts through a control linkage of the recliner mechanism to move the four-bar linkages between an upright position and a reclined position. Movement of the four-bar linkages from the upright position to the reclined position locates the seat and backrest upwardly and forwardly relative to their respective locations when in the upright position to move the backrest away from the wall. An adjustment mechanism interposed between the control linkage and the four-bar linkages enables movement of the four-bar linkages without actuation of the power actuator. In a modified embodiment, the backrest is tiltable relative to the seat. The backrest does not move closer to a wall when the chair is operated between the upright position and an intermediate position, and the backrest moves only minimally toward the wall when the chair is operated from the intermediate position to a fully reclined position.

29 Claims, 5 Drawing Sheets

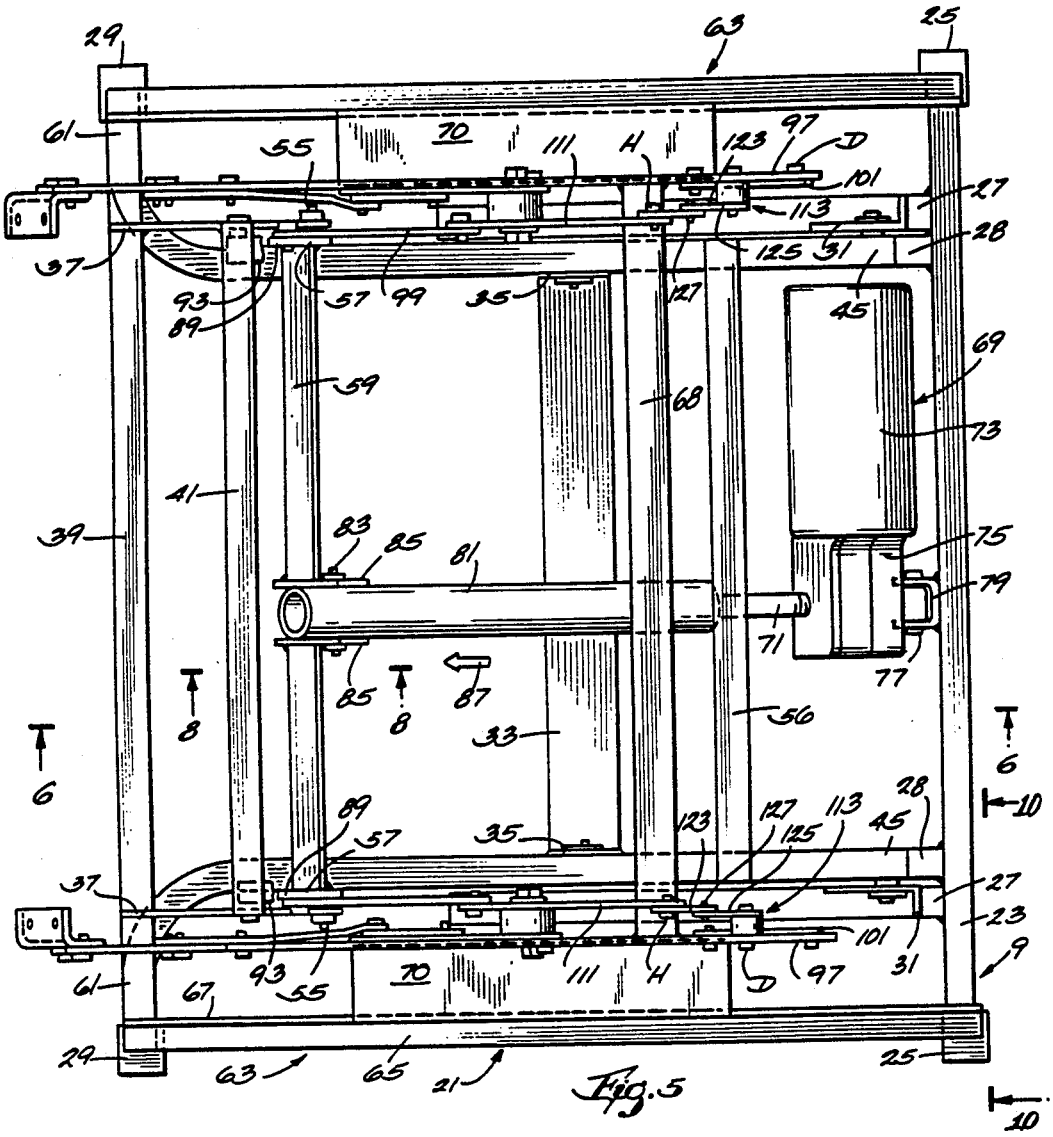
Fig. 5
Fig. 10
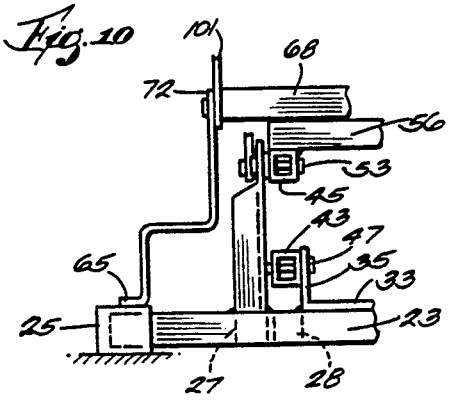
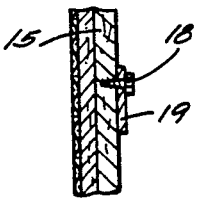
Fig. 11

RECLINE LIFT WALL HUGGER CHAIR

BACKGROUND OF THE INVENTION

1. Field of the Invention

This invention pertains to chairs, and more particularly to reclining lift chairs.

2. Description of the Prior Art

Reclining chairs, which are movable between upright and reclined positions, are well known. Some reclining chairs are designed such that their backrests do not move rearwardly as the chair moves between an upright position and the reclined position. Such so-called wall hugger chairs are quite popular, because they do not require any clearance between the backrest and a nearby wall in order to operate properly, and thus they conserve space in a room.

Prior wall hugger reclining chairs may be operated between the upright and reclined positions by shifting the weight of a person sitting in the chair. In some designs, the chair includes a handle that forms a part of the chair recliner mechanism. By actuating the handle, the chair occupant is able to control the chair position. Typical examples of prior wall hugger chairs are described in U.S. Pat. Nos. 3,836,197; 4,306,746; and 4,577,902.

Although the prior wall hugger reclining chairs have enjoyed a certain degree of popularity, they nevertheless possess certain disadvantages. A common disadvantage is that in many chairs movement between positions is undesirably jerky and uncomfortable. Probably the primary disadvantage relates to the force a person must exert through his arms, back, and legs in order to change chair positions. Because of age, illness, or other reasons, many persons find it difficult, uncomfortable, and even impossible to expend the bodily force required to change chair positions.

Another well known type of chair is the lift or elevator chair. In a lift chair, the seat and backrest are connected by suitable linkages to a base that rests on the floor. A power actuator drives the linkages to raise the seat and backrest above their normal upright positions. Simultaneously, the linkages cause the seat and backrest to tilt forwardly. The result is that elderly or infirm persons are assisted to their feet after sitting in the chair.

Some lift chairs also include mechanisms for reclining. Exemplary combination recline lift chairs are disclosed in U.S. Pat. Nos. 4,007,960; 4,852,939; and 4,909,569. The recline lift chairs of the foregoing patents operate very smoothly, and they fulfill their intended purposes very well. However, they are subject to further development from the standpoint of incorporating the wall hugging feature into them.

SUMMARY OF THE INVENTION

In accordance with the present invention, a recline lift wall hugger chair is provided that includes a wall hugging feature in a powered recline lift chair. This is accomplished by apparatus that includes novel power driven mechanisms designed to move the chair backrest away from an adjacent wall while imparting smooth and comfortable recline motions to the chair occupant The recline lift wall hugger chair is generally symmetrical about a longitudinal center line. The chair is comprised of a base that rests on a floor. Pivotally connected to the base is a lift mechanism. A recliner mechanism is pivotally supported by the lift mechanism, and a seat frame is fastened to the recliner mechanism. The seat frame includes a seat and a backrest. The lift mechanism is used to move the seat and backrest under power between an upright position and a lift position without affecting the recliner mechanism. The recliner mechanism is used to position the seat and backrest between the upright position and a reclined position in a manner that moves the top portion of the backrest forwardly away from an adjacent wall and that does not affect the lift mechanism.

The lift mechanism is composed, on both sides of the chair, of first and second unequal length swing arms. Each swing arm has a first end pivotally connected to the base and a second end pivotally connected to a generally vertical plate. A cross brace extends laterally between and is joined to the two vertical plates. Rigidly joined to each vertical plate is a vertically oriented side plate. The side plates extend longitudinally for approximately the same length as the chair base.

To move the seat and backrest under power between the upright and lift positions, the chair of the present invention includes a linear actuator pivotally secured between the base and the lift mechanism. The linear actuator may be a screw and nut arrangement driven by an electric motor and speed reducer. One end of the linear actuator, such as a tubular nut, is pivotally secured by means of one or more lever plates to a cross brace that extends between two driver links. Each driver link is pivotally connected to a respective vertical plate of the lift mechanism. The second end of the linear actuator, such as the speed reducer housing, is pivotally secured to the base. By actuating the motor, the screw is rotated to translate the nut. The nut in turn acts through the lever plates and cross brace to cause rotation of the driver links about their pivotal connections with the vertical plates.

The chair of the present invention is operated in a lift mode by actuating the linear actuator to translate the nut in a first direction. Translation of the nut in the first direction causes the driver links to rotate about the vertical plates until the distal ends of the driver links contact the cross brace between the two vertical plates. From that point, further relative rotation between the driver links and the vertical plates is prevented. However, further actuation of the linear actuator and translation of the nut in the first direction is possible. Such actuation causes the nut to force the lift mechanism, and the recliner mechanism supported thereon, to lift as a unit by means of the first and second swing arms from the base. Simultaneously, the seat frame and backrest, which are fastened to the recliner mechanism, also lift with the lift mechanism. In addition, the angular attitude in space of the recliner mechanism, seat frame, and backrest changes because of the different lengths of the first and second swing arms to cause the seat frame and backrest to tilt forwardly.

From the lift position, reversal of the linear actuator from the first direction to a second direction causes the recliner mechanism, seat frame, and backrest to lower and tilt backwardly as a unit. Lowering continues until the lift mechanism side plates contact the chair base. During chair operation in the lift mode, no relative motion occurs between the lift mechanism and the recliner mechanism.

The point at which the distal ends of the driver links are in contact with the cross brace between the lift mechanism vertical plates and the lift mechanism side plates are in contact with the chair base is called the transfer point. The chair is designed such that the seat and backrest are in the upright position when the driver links and side plates are at the transfer point.

To operate the chair in a recline mode, the linear actuator is actuated in the second direction from the transfer point. During operation in the recline mode, there is no relative motion between the lift mechanism and the base. The linear actuator nut translates along the screw to cause the driver links to rotate relative to the vertical plates and to open a gap between the distal ends of the driver links and the lift mechanism cross brace. Such rotation of the driver links operates a pair of four-bar linkages through corresponding pairs of first and second control links. Each first control link has a first end pivotally connected to the distal end of an associated driver link. The second end of the first control link is pivotally connected to the first end of the associated second control link. The second control link is pivotally connected between its two ends to a side plate of the lift mechanism. The second end of the second control link is pivotally connected to the associated four-bar linkage. Each four-bar linkage thus includes a lift mechanism side plate. Each four-bar linkage also includes a seat link that serves as the member to which the seat frame is fastened, and front and back links that connect the lift mechanism side plate to the seat link. A footrest mechanism is pivotally connected between the seat links and the front links.

Further in accordance with the present invention, the four-bar linkages and thus the seat and backrest, may be moved without actuating the power actuator. That is achieved by interposing an adjustment link between each second control link and the corresponding four-bar linkage. The adjustment link comprises first and second short links, each having first and second ends. The first end of the first short link is pivotally connected to the second end of the second control link. The first end of the second short link is pivotally connected to the seat link. The second ends of the two short links are adjustably joined, as by a slot and fastener arrangement, in a manner that allows the distance between the first ends of the two short links to be varied. In that manner, the four-bar linkage can be moved without moving the control links or the linear actuator.

The first and second control links, as well as the front and back links of the four-bar linkages, are designed such that actuation of the linear actuator from the upright position to the reclined position causes the seat links to smoothly move forwardly and upwardly. The proportions of the various links are further designed such that the top of the backrest moves forwardly as the seat links move between the upright and reclined positions. The chair backrest may thus be placed proximate a wall and the chair operated in both lift and recline modes without contact between the backrest and the wall.

From the reclined position, actuation of the linear actuator in the first direction causes reversal of the rotation of the driver links about the vertical plates. Reversal of the driver links operates through the first and second control links to return the recliner mechanism and thus the chair and seat backrest to the upright position. The upright position is attained when the distal ends of the driver links again contact the lift mechanism cross brace at the transfer point. Thus, it is seen that the chair of the present invention is selectively operable from the transfer point in a lift mode or in a recline mode.

In a modified embodiment of the present invention, the backrest is capable of tilting backwardly relative to the seat so as to provide a more fully reclined configuration than is possible with the fixed seat-backrest design. The tilting backrest employs a pair of crank arms rigidly joined to the lower portion of the backrest near the seat frame. The crank arms are also pivotally connected to the seat link of the four-bar linkage. In addition, a pair of crank arm links pivotally connect the crank arms to corresponding lift mechanism side plates. The crank arms and crank arm links are dimensioned such that actuation of the recliner mechanism to move the seat frame upwardly and forwardly also causes the crank arms at their connections with the seat links to move upwardly and forwardly. Simultaneously, the crank arms at their connections with their corresponding crank arm links move forwardly but to a lesser height than the connections between the crank arms and the seat links. As a consequence, the crank arms rotate in space to tilt the backrest backwardly relative to the seat.

The chair can be reclined from the upright position to an intermediate position without the top portion of the backrest moving backwardly to strike an adjacent wall or the like. That is because the forward motion of the lower portion of the backrest and the crank arms compensates for the backward tilt of the backrest. Even tilting the backrest to the fully reclined position maintains the backrest top portion within a very short horizontal distance of its location when the chair is in the upright position.

Other objects and advantages of the invention will become apparent upon reading the detailed description of the invention.

BRIEF DESCRIPTION OF THE DRAWINGS

FIG. 5 is a view taken along lines 5—5 of FIG. 4.

FIG. 10 is a view taken along lines 10—10 of FIG. 5.

FIG. 11 is an enlarged cross-sectional view taken along lines 11—11 of FIG. 1.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
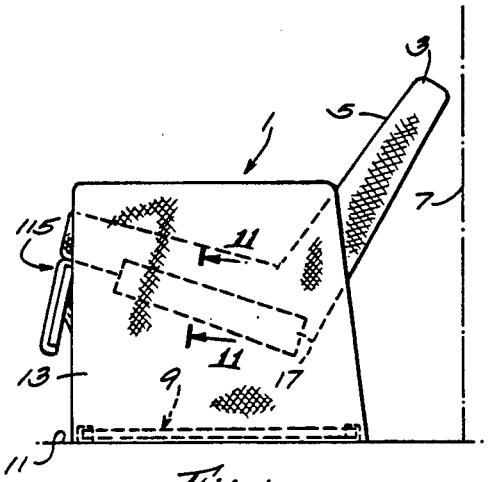
FIG. 1 is a side view of the recline lift wall hugger chair of the present invention shown in an upright position.
Figure 2:
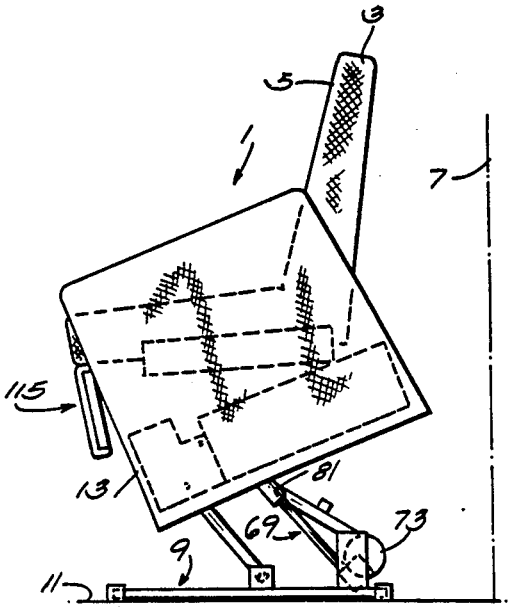
FIG. 2 is a side view of the chair of the present invention shown in a lift position.
Figure 3:
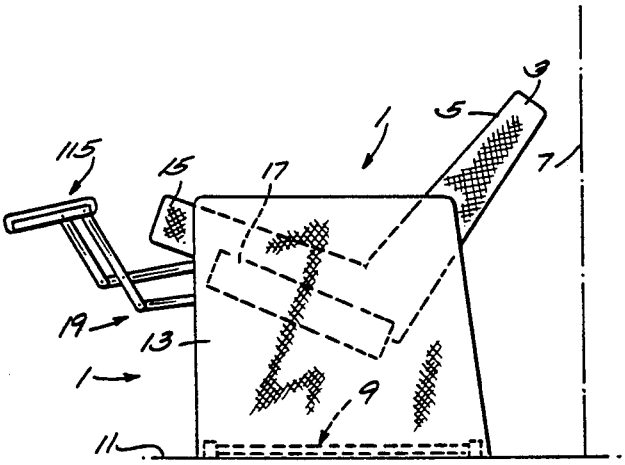
FIG. 3 is a side view of the chair shown in a reclined position.

Referring to FIGS. 1-3, a recline lift wall hugger chair 1 is illustrated and includes the present invention. The chair 1 combines smooth powered operation between an upright position shown in FIG. 1, a lift position shown in FIG. 2, and a reclined position shown in FIG. 3 with wall hugging characteristics. Particularly the top portion 3 of the chair backrest 5 does not move closer to a wall or similar object 7 as the chair is operated between the upright and reclined positions. In fact, the chair may be designed such that the top portion 3 of the backrest 5 moves toward the front of the chair and away from the wall 7, as shown in FIG. 3, as the chair is operated to its reclined position.

General

The chair 1 is generally comprised of a base 10 9 that is supported on a floor 11. The chair has a seat 15 that is attached to a seat frame 17. The backrest 5 is rigidly attached to the seat frame 17.

In turn, the seat frame 17 is fastened to a recliner mechanism 19, as by conventional fasteners 18, FIG. 11. The recliner mechanism 19 is pivotally supported on a lift mechanism 22, FIG. 4. Finally, the lift mechanism 21 is pivotally connected to the base 9. Chair sides 13, which may be conventional, are secured to the lift mechanism 21 in any suitable manner. A power system 22 is employed to operate the chair 1 between the upright, lift, and reclined positions, FIGS. 1, 2, and 3, respectively.

Base

Figure 4:
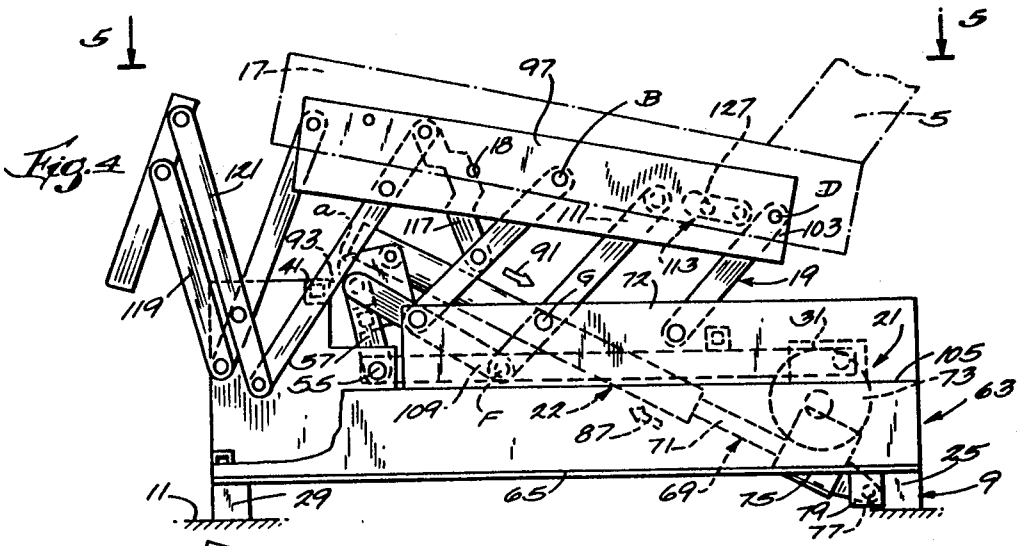
FIG. 4 is a partially broken side view of the lift and recliner mechanisms of the present invention shown in the upright position.
Figure 6:
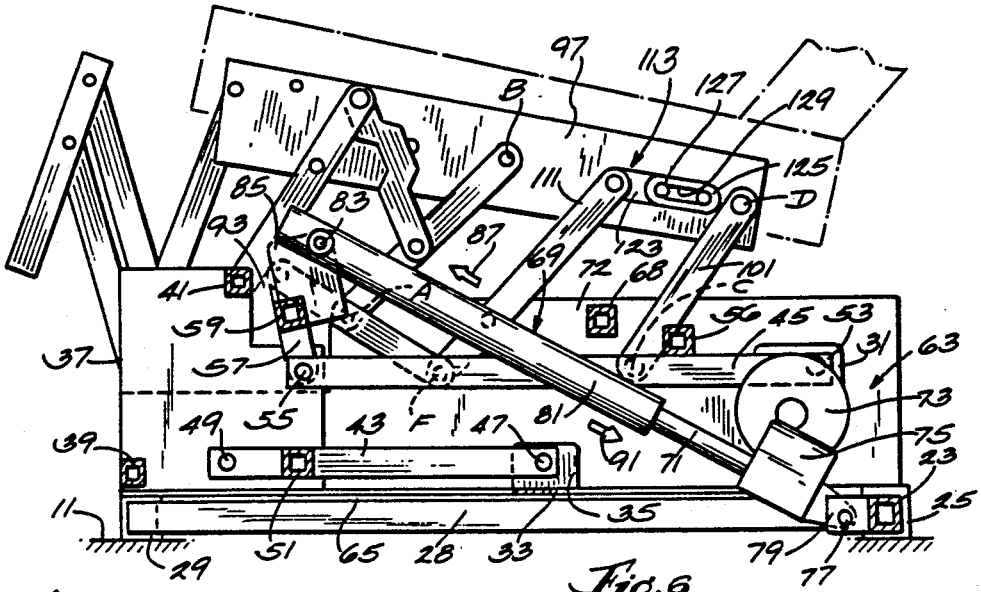
FIG. 6 is a cross-sectional view taken along lines 6—6 of FIG. 5.

With particular attention to FIGS. 4 and 6, the base 9 of the chair 1 includes a laterally extending back member 23, which may be a square tube. Rubber caps 25 cover the ends of the back member 23. A first pair of parallel tubes 27 are welded to the back member 23 and extend longitudinally part way to the front of the chair. A second pair of tubes 28 are also welded to the back member and extend completely to the chair front end, where they curve outwardly and terminate in respective ends that are covered with caps 29. The caps 25 and 29 rest on the floor 11.

Welded to each tube 27 is an upright angle 31. A long plate 33 with upstanding ends 35 extends between and is welded to the longitudinal base members 28.

Lift Mechanism

Pivotally connected to the base 9 is the lift mechanism 21. In the illustrated construction, the lift mechanism is comprised of a pair of laterally spaced vertical plates 37 joined by a pair of cross braces 39 and 41. The cross braces 39 and 41 may be 10 square tubes. Each vertical plate 37 is pivotally connected to the base by a first swing arm 43 and a second swing arm 45. Also see FIGS. 6 and 7. One end of the first swing arm 43 is pivotally connected at pin 47 to an upstanding end 35 of the plate 33 welded between the base longitudinal members 28. The second end of the swing arm 43 is pivotally connected at pin 49 to a vertical plate 37. A cross brace 51 joins the two swing arms 43.

One end of the second swing arm 45 is pivotally connected at pin 53 to one of the upright angles 31 welded to the longitudinal base member 27. The other end of the swing arm 45 is pivotally connected at pin 55 to a vertical plate 37. Tubular brace 56 joins the two second swing arms 45 to each other.

The brace 39 between the two vertical plates 37 has portions 61 that extend beyond the respective vertical plates. To the end of each brace portion 61 is welded a generally vertical side plate 63. Looking also at FIG. 10, each side plate 63 has a foot section 65 joined to an upright section 67. The brace portions 61 are welded to the associated upright sections 67 of the side plates. The top of each side plate upright section 67 terminates in an inturned horizontal section 70 and a vertical upper section 72. A cross brace 68 joins the vertical upper sections 72 of the two side plates to each other. It is preferred that the chair sides 13 be joined to the side plates 63.

Power System

To move the seat 15 and backrest 5 between the upright position of FIG. 1 and the lift position of FIG. 2, the chair 1 further comprises the power system 22. Referring especially to FIGS. 4, 5, and 7, 10 the power system includes a linear actuator 69, which may be in the form of a screw 71 rotated by an electric motor 73 acting through a right angle speed reducer 75. The housing of the speed reducer 75 is pivotally secured by a pin 77 to a bracket 79 welded to the base back member 23. Mating with the linear actuator screw 71 is a tubular nut 81.

The power system 22 further comprises a pair of driver links 57. One end of each driver link 57 is pivotally connected to a corresponding vertical plate 37 at the pin connection 55 between the vertical plate and the associated second swing arm 45. The two driver links are joined together by a cross brace 59. The nut 81 is pivotally connected at pin 83 to one or more lever plates 85 that are welded to the cross brace 59 between the two driver links 57.

Figure 8:
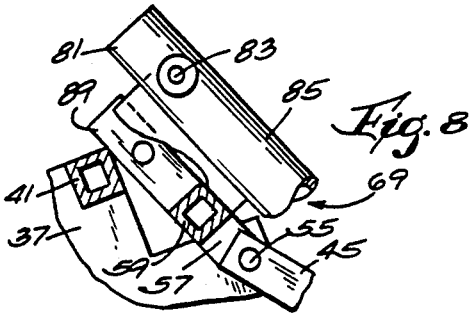
FIG. 8 is an enlarged cross-sectional view taken along lines 8—8 of FIG. 5 showing various chair components at the transfer point between the lift and recline modes of operation.
Figure 7:
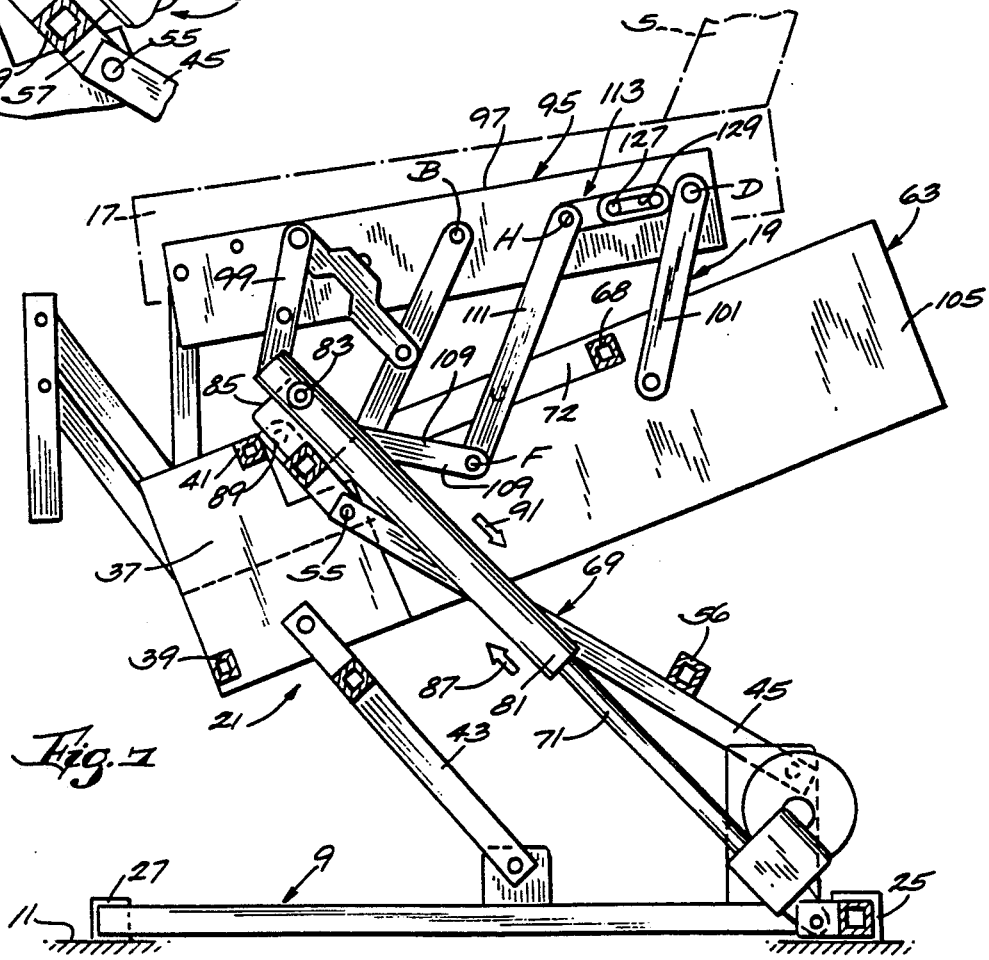
FIG. 7 is a view similar to FIG. 6, but showing the chair lift and recliner mechanisms in the lift position.

Actuation of the linear actuator 69 to move the nut 81 in the direction of arrow 87 relative to the screw 71 and the base 9 tends to rotate the lever plates 85 and driver links 57 counterclockwise with respect to FIGS. 4 and 7 about the pins 55. The driver links are designed such that their counterclockwise rotation is limited by the contact of their respective distal ends 89 with the cross brace 41 between the two vertical plates 37. Also see FIG. 8. Upon contact between the driver links distal ends 89 and the cross brace 41, further actuation of the linear actuator to translate the nut in the direction of arrow 87 places the chair 1 in a lift mode by causing the driver links and the vertical plates to lift relative to the base 9 by means of the first and second swing arms 43 and 45, respectively, FIG. 7. The two side plates 63 lift in unison with the vertical plates 37 by means of the brace portions 61 therebetween (FIG. 5). Because of the unequal lengths of the swing arms, the vertical plates and side plates tilt forwardly as they lift. Since the seat frame 17 is supported by the lift mechanism side plates and vertical plates through the recliner mechanism 19, the seat 15 and backrest 5 acquire the lift position of FIG. 2.

From the lift position of FIG. 7, reversing the linear actuator 69 such that the nut 81 translates in the direction of arrow 91 causes the lift mechanism 21 to return to the upright position of FIGS. 1, 4, and 6. The side plates 63 lower until their respective foot sections 65 rest on and are cushioned by the base caps 25 and 29. The point at which the side plates are in contact with the base caps and simultaneously the distal ends 89 of the power system driver links 57 are in contact with the cross brace 41 is called the transfer point. The chair 1 is in the upright position at the transfer point. From the transfer point, any further translation of the nut 81 in the direction of arrow 91 causes the driver links 57 and the lever plates 85 to rotate clockwise with respect to FIGS. 4 and 6–8 about the pins 55. Consequently, a gap 93 is formed between the cross brace 41 and the distal ends 89 of the driver links, such as is shown in FIGS. 4 and 6. For clarity, the transfer point per se is not illustrated in those two figures, although they do show the chair 1 in substantially the upright position.

Recliner Mechanism

Figure 9:
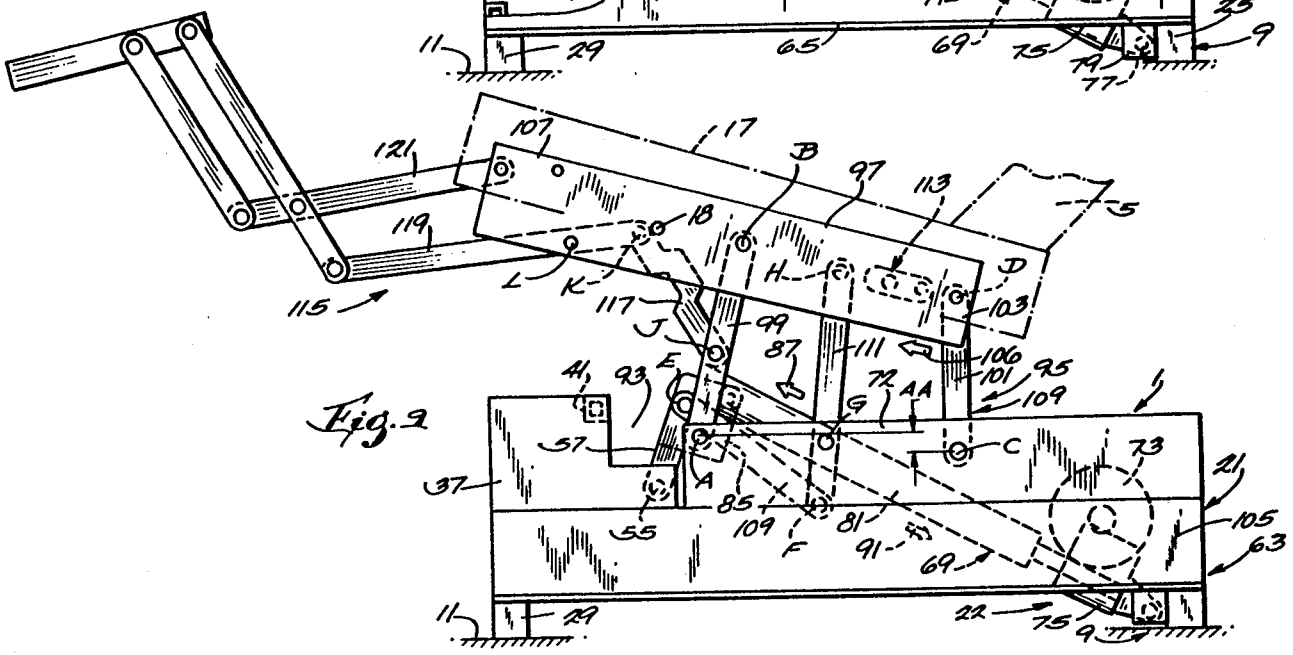
FIG. 9 is a view similar to FIG. 6, but showing the chair lift and recliner mechanisms in the reclined position.

To operate the chair 1 between the upright position of FIGS. 1, 4, and 6 and the reclined position of FIGS. 3 and 9, the recliner mechanism 19 comprises a pair of laterally spaced four-bar linkages 95. The four-bar linkages 95 are operated in the recline mode independently of the lift mechanism 21. 10 In the preferred embodiment, each four-bar linkage 95 includes the vertical upper section 72 of a side plate 63 as one of the links. A seat link 97, a front link 99, and a back link 101 complete the four-bar linkage. The seat frame 17 is fastened to the seat link 97, as by fasteners 18, so that the seat 15 acquires the same location in space as the seat links 97. The location and orientation of the backrest 5 are also governed by the seat links 97.

Front link 99 of the four-bar linkage 95 will also be referred to as link AB in correspondence to the pin connection A between the front link and the side plate vertical upper section 72 and the pin connection B between the front link and the seat link 97. Back link 101 will also be referred to as link CD in correspondence with the pin connections C and D between the back link and the side plate vertical upper section and the seat link, respectively.

When the chair 1 is in the upright position of FIGS. 1, 4, and 6 and in the lift position of FIGS. 2 and 7, the seat links 97 of the recliner mechanism four-bar linkages 95 are generally parallel to the horizontal section 70 of the lift mechanism side plates 63 (FIG. 10). In addition, the back ends 103 of the seat links are relatively close to the back ends 105 of the associated side plates 63.

FIG. 9 shows the chair recliner mechanism 19 in the reclined position, whereat the entire seat links are located upwardly and forwardly in the direction of arrow 106 relative to their locations in the upright position. In the reclined position, the front ends 107 of the seat links 97 are at a higher level than the seat link back ends 103, and the seat link back ends 103 are relatively far from the side plate back ends 105. Consequently, the seat 15 and back rest 5 of the chair 1 acquire their respective reclined positions, and the top portion 3 of the backrest moves forwardly away from the wall 7, FIG. 3.

To operate the chair 1 in the recline mode from the upright position of FIGS. 1, 4, and 7 to the reclined positions of FIGS. 3 and 9, the motor 73 of the power system 22 is actuated to translate the nut 81 in the direction of arrow 91 its location when the chair is at the transfer point. As mentioned, such actuation causes the driver links 57 and the lever plates 85 to rotate clockwise with respect to FIGS. 4 and 6–8 from the transfer point, opening the gap 93 between the distal ends 89 of the respective driver links and the cross bar 41.

To move the four-bar linkages 95 to the reclined position upon actuation of the linear actuator 69 in the recline mode, the recliner mechanism 19 further comprises a pair of first control links 109 and a pair of second control links 111. Each first control link 109 will also be referred to as link EF in correspondence to its pin connection E with the distal end 89 of a respective driver link 57 and pin connection F with one end of the second control link 111. Link 111 will also be referred to as link FGH in correspondence to its pin connection F with the link EF, pin connection G with the vertical upper section 72 of the side plate 63, and pin connection H with one end of an adjustment link 113.

Upon clockwise rotation (with respect to FIG. 9) of the power system driver links 57 from the upright position of FIGS. 1, 4 and 6, the first control links 109 push the corresponding second control links 111 to rotate counterclockwise about pin connections G with their respective lift mechanism side plates 63. Consequently, the second control links pull, through adjustment links 113, the four-bar linkages 95 to raise and move forwardly the seat links 97 with respect to the lift mechanism 21 and base 9 to the reclined position of FIGS. 3 and 9. Further, operation of the chair 1 in the recline mode from the upright position moves the top portion 3 of the backrest 5 forwardly away from the wall 7.

The recliner mechanism 19 preferably includes a footrest mechanism 115. The footrest mechanism 115 operates between a closed position when the chair 1 is in the upright and lift positions of FIGS. 1 and 2, respectively, and an open position when the chair is in the reclined position, FIG. 3. Looking especially at FIG. 9, the footrest mechanism operates in correlation with the recline mode through pairs of links 117, 119, and 121. Each link 117 is also referred to as link JK for its pin connection J with front link 99 and pin connection K with seat link 97 of the associated four-bar linkage 95. Each link 119 has a first pin connection K with the link 117 and another pin connection L with the seat link 97.

Further in accordance with the present invention, the adjustment links 113 provide the ability to position the four-bar linkages 95, and thus the seat frame 17, relative to the chair base 9 and the lift mechanism 21 without actuating the linear actuator 69. For that purpose, and referring to FIGS. 5 and 6, each adjustment link 113 is comprised of first and second short links 123 and 125. Each short link 123, 125 has one end pivotally connected to a link 111 and 101, respectively. The second end of link 123 has a hole therethrough, and the second end of the link 125 has a slot 129 therethrough. A carriage bolt and nut or similar fasteners 127 adjustably join the hole in the link 123 and the slot 129 in the link 125. By manipulating the links 123 and 125 and the fasteners 127, the four-bar linkages are adjustable without actuating the linear actuator.

From the reclined position of FIG. 9, reversal of the linear actuator to cause the nut 81 to translate in the direction of arrow 87 will cause the driver links 57 and lever plates 85 to rotate counterclockwise with respect to FIG. 9. Counterclockwise rotation of the driver links causes the control links 109 and 111 to return the four-bar linkage 95, and thus the chair frame 17 and backrest 5, to the upright position. The upright position is obtained when the gap 93 disappears and the distal ends 89 of the driver links contact the cross brace 41 at the transfer point. Simultaneously, the footrest mechanism 115 returns to its closed position of FIGS. 1, 4 and 6. Any further translation of the nut 81 in the direction of arrow 87 will operate the lift mechanism 21 in the lift mode as previously described. In that manner, the chair 1 is operable in either the lift mode or the recline mode from the upright position and the transfer point, and continued actuation of the linear actuator in the lift or recline mode through the upright position and transfer point automatically causes the chair to operate in the other mode.

The relative proportions of the various links and other components of the recliner mechanism 19 are quite important for the successful operation of the chair 1. For example, it has been found that a length AB of 7.06 inches, a length CD of 5.57 inches, and a vertical distance AA between pin connections A and C on the vertical upper section 72 of each side plate 63 of between approximately 1.50 inches and 1.70 inches are required to produce uniform motion of the seat frame 17 and to prevent jerky movement. The preferred dimension for distance AA is approximately 1.60 inches. With the foregoing dimensions and a length BD of approximately 8.00 inches and a length AC of approximately 10.20 inches, the four-bar linkage 95 provides very smooth motion to the chair occupant.

Other important geometrical relations include the fact that the links FGH must range between an angle greater than 0° and less than 90° relative to the horizontal during the recline mode. Further, the horizontal distance between the pin connections 55 and G is determined to be approximately 6.25 inches. The foregoing values of angular rotation of the links FGH and horizontal spread between pin connections 55 and G prevent the seat 15 and backrest 5 from jerky motion when an occupant leans rearwardly in the chair 1. In addition, the length between the pin connections 55 and E of the driver links 57 is desirably between 3.00 inches and 5.00 inches, and the distance between the pin connections G and H is between 5.00 inches and 6.00 inches. The preferred dimension between pin connections 55 and E is 4.00 inches, and the preferred distance between the pin connections G and H is 5.53 inches. Those dimensions are selected to prevent jerky motion and to reduce the force and stroke required to operate the chair in the recline mode.

With the various dimensions as given above, the preferred dimension for the length BJ is between approximately 4.00 inches and 4.80 inches, and the length JK of link 117 is between approximately 4.28 and 5.43 inches. The respective optimum dimensions BJ and JK are 4.80 inches and 5.43 inches. With the dimensions as given, the chair 1 operates under power in a very smooth manner between the upright position of FIG. 1 and the full recline position of FIGS. 3 and 9, and the top portion 3 of the backrest 5 moves away from the wall 7.

Tilting Backrest

Figure 12:
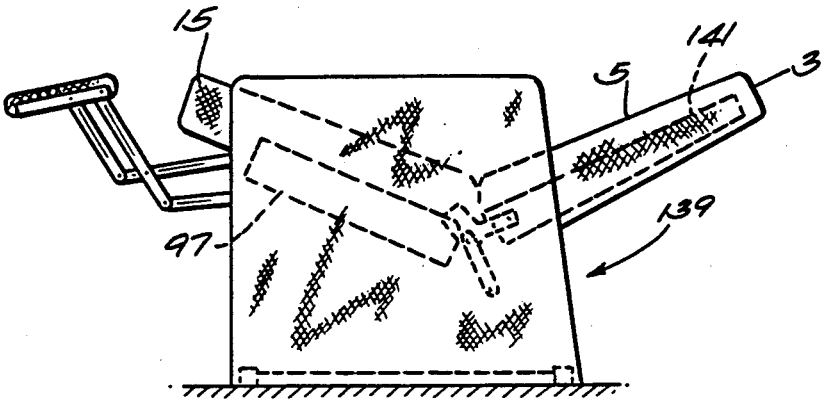
FIG. 12 is a side view of a modified recline lift wall hugger chair shown in the fully reclined position.
Figure 13:
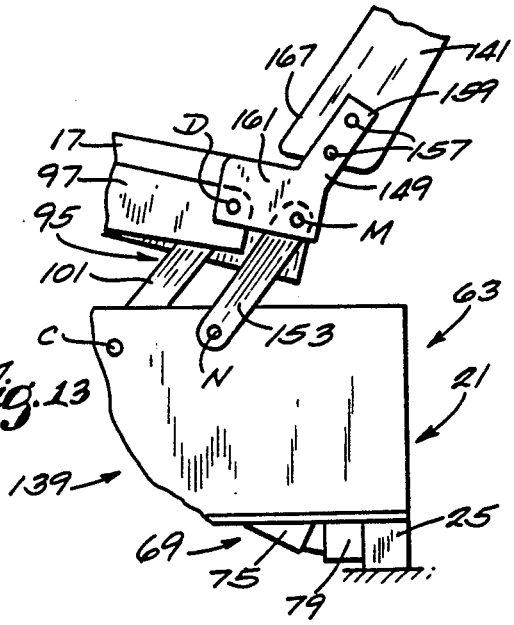
FIG. 13 is an enlarged side view of the connections between the lift mechanism, recliner mechanism, and backrest of the chair of FIG. 12, but showing the chair in an upright position.
Figure 14:
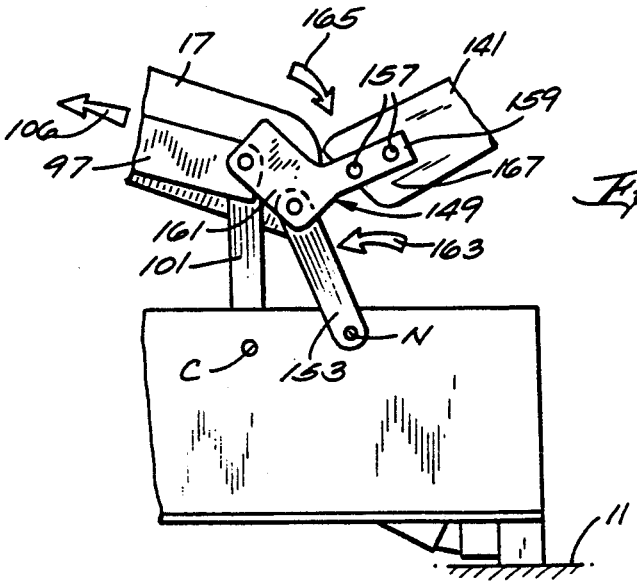
FIG. 14 is a view similar to FIG. 13, but showing the chair in the fully reclined position.

Turning to FIGS. 12–14, a modified chair 139 is shown in which the backrest 5 is tiltable relative to the seat 15. In the illustrated construction, tilting connection between the backrest and the seat is achieved by means of a generally L-shaped crank arm 149 on each side of the chair 139. Each crank arm 149 has a first leg 159 rigidly fixed with fasteners 157 to a member 141 that forms part of the backrest. Each crank arm 149 has a second leg 161 that is pivotally connected to the seat link 97 of the four-bar linkage 95 at the same connection D as the connection between the four-bar linkage link 101 and the seat link 97. (See FIGS. 4 and 9.) Each crank arm leg 161 is also pivotally connected at pin M to one end of an associated crank arm link 153. The second end of each crank arm link 153 is pivotally connected at pin N to a side plate 63 of the lift mechanism 21. Links 153 are shorter than the links 101.

When the chair 139 is in the upright position of FIG. 13, the links 101 and 153 are approximately parallel. Upon actuation of the power actuator 69 in the recline mode, the seat link 97 moves upwardly and forwardly in the direction of arrow 106, as was described previously in connection with FIGS. 3 and 9. Such movement of the seat link pulls the pin connections D between the crank arms 149 and the seat links 97 upwardly and forwardly. As the pin connections D move forwardly, links 153 pivot in the direction of arrow 163 about their respective pin connections N. Because of the short links of the crank arms links 153 relative to the four-bar linkage links 101, the crank arm links force the crank arms to 10 tilt in space in the direction of arrow 165 relative to the seat links 97. The result is that the lower portion 167 of the backrest 5 moves forwardly and the entire backrest tilts backwardly relative to the seat 15.

The power actuator 69 is operable to place the chair 139 in the upright position of FIGS. 1 and 13 and in the fully reclined position of FIGS. 12 and 14. Further, the power actuator is operable to place the chair in an intermediate position, not shown, between the upright and fully reclined positions. At the intermediate position, the forward travel of the backrest lower portion 167 compensates for the tilting of the backrest top portion 3. The result is that there is no appreciable backward movement of the backrest top portion relative to its location when the chair is in the upright position.

Additional reclining of the chair 139 from the intermediate position to the fully reclined position of FIGS. 12 and 14 results in a net backward movement of the backrest top portion 3. However, such backward movement is quite small. By appropriately designing the links 101 and 153 and the crank arms 149, the backrest top portion moves rearwardly as little as 2.50 inches from its location when the chair is in the intermediate position.

Thus, it is apparent that there has been provided, in accordance with the invention, a recline life wall hugger chair that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A recline lift wall hugger chair comprising:

a. a base;

b. a seat with a backrest rigidly attached thereto, the backrest having a top portion that is locatable at a predetermined distance from a vertical wall;

c. linkage means for pivotally connecting the seat and backrest to the base; and d. a linear actuator for selectively moving the linkage means between an upright position whereat the top portion of the backrest is located at the predetermined distance from the vertical wall, a reclined position whereat the backrest top portion is located at a distance grater than the predetermined distance from the wall, and a lift position wherein the seat and backrest are tilted forwardly and upwardly to assist the occupant of the chair from a seated position to a standing position.

2. The recline lift wall hugger chair of claim 1 wherein the linkage means comprises:

a. lift means pivotally connected to the base for moving between an upright position and a lift position that is at a higher level and tilted forwardly relative to the upright position; and b. recliner means pivotally supported by the lift means for moving between the upright position and the reclined position, the seat being fastened to the recliner means.

3. The recline lift wall hugger chair of claim 2 wherein the recliner means comprises:

a. a pair of laterally spaced four-bar linkages, each four-bar linkage having two points on the base as one of the linkages and two points on the seat as another of the linkages;

b. a first control link in association with each four-bar linkage, each first control link having a first end pivotally connected to the power means and a second end; and c. a second control link in association with each four-bar linkage, the second control link having a first end pivotally connected to the second end of a corresponding first control link and a second end pivotally connected to a corresponding seat link, the second control link being pivotally connected intermediate its first and second ends to the lift means, so that actuation of the power means in the recline mode causes the first and second control links to move the four-bar linkage between the upright and reclined positions.

4. The recline lift wall hugger chair of claim 3 further comprising adjustment means interposed between the second end of each second control link and the associated seat link for manually changing the distance between said links, thereby enabling the associated four-bar linkage to be moved from a position in which said seat is upright to a position in which said seat is reclined without actuation of the power means.

5. The recline lift wall hugger chair of claim 4 wherein the adjustment means comprises:

a. a first adjustment link having one end pivotally connected to the second end of the second control link and a second end;

b. a second adjustment link having one end pivotally connected to the seat link and a second end; and c. fastener means for adjustably joining the second ends of the first and second adjustment links to each other, so that the distance between the first ends of the first and second adjustment links can be varied to thereby move the four-bar linkage without actuating the power means.

6. The recline lift wall hugger chair of claim 2 further comprises:

a. a pair of laterally spaced driver links, each driver link having a first end pivotally connected to the lift means and a distal end that is connected to the first end of a respective first control link;

b. lever means extending between and joined to the driver links; and c. said linear actuator being pivotally secured between the base and the lever means, so that actuation of the linear actuator means causes rotation of the driver links about the first end thereof.

7. A recline lift wall hugger chair comprising:

a. a generally planar base;

b. lift means pivotally connected to the base for moving between an upright position and a lift position that is at a higher level and tilted forwardly relative to the upright position;

c. recliner means pivotally supported by the lift means for moving between an upright position and a reclined position, the recliner means comprising a pair of laterally spaced seat links that are in a first location when the recliner means is in the upright position and in a second location upwardly and forwardly of the first location when the recliner means is in the reclined position;

d. a seat frame fastened to the recliner means seat links and having a backrest rigidly attached thereto, the backrest having a top portion that remains at least at a predetermined distance from a selected vertical surface proximate thereto when the recliner means moves between the upright and reclined positions; and e. power means pivotally secured to the base for selective actuation in a lift mode to move the lift means between the upright and lift positions and in a recline mode to move the recliner means between the upright and reclined positions, so that the chair may be operated under power between the upright and reclined positions without the backrest approaching the selected vertical surface proximate thereto.

8. The recline lift wall hugger chair of claim 7 wherein the recliner means further comprises:

a. a pair of laterally spaced four-bar linkages, each four-bar linkage having a selected component of the lift means as one of the linkages and a seat link as another of the linkages;

b. a first control link in association with each four-bar linkage, each first control link having a first end pivotally connected to the power means and a second end; and c. a second control link in association with each four-bar linkage, the second control link having a first end pivotally connected to the second end of a corresponding first control link and a second end pivotally connected to a corresponding seat link, the second control link being pivotally connected intermediate its first and second ends to the lift means, so that actuation of the power means in the recline mode causes the first and second control links to move the four-bar linkage between the upright and reclined positions.

9. The recline lift wall hugger chair of claim 8 further comprising adjustment means interposed between the second end of each second control link and the associated seat link for manually changing the distance between said links, thereby enabling the associated four-bar linkage to be moved from a position in which said seat is upright to a position in which said seat is reclined.

10. The recline lift wall hugger chair of claim 9 wherein the adjustment means comprises:

a. a first adjustment link having one end pivotally connected to the second end of the second control link and a second end;

b. a second adjustment link having one end pivotally connected to the seat link and a second end; and c. fastener means for adjustably joining the second ends of the first and second adjustment links to each other, so that the distance between the first ends of the first and second adjustment links can be varied to thereby move the four-bar linkage without actuating the power means.

11. The recline lift wall hugger chair of claim 8 wherein the power means comprises:

a. a pair of laterally spaced driver links, each driver link having a first end pivotally connected to the lift means and a distal end that is connected to the first end of a respective first control link;

b. lever means extending between and jointed to the driver links; and c. linear actuator means pivotally secured between the base and the lever means, so that actuation of the linear actuator means causes rotation of the driver links about the first end thereof.

12. The recline lift wall hugger chair of claim 11 wherein:

a. the second control link pivots with respect to the lift means between an angle greater than 0° and less than 90° relative to the plane of the base;

b. the distance between the pivotal connection (A) of the driver link first end with the lift means and the pivotal connection (G) of the second control link with the lift means is approximately 6.25 inches;

c. the length between the pivotal connections (EF) of the first control link is between approximately 3.00 inches and 5.00 inches; and d. the length between the pivotal connection (G) of the second control link with the lift means and the pivotal connection (H) of the second control link with the seat link is between approximately 5.00 inches and 6.00 inches, so that the control links are dimensioned to minimize the force and stroke required to smoothly operate the chair in the recline mode.

13. The recline lift wall hugger chair of claim 12 wherein the length between the pivotal connections (EF) of the first control link is approximately 4.00 inches, and wherein the length between the pivotal connections (G) and (H) of the second control link with the lift means and the seat link, respectively, is approximately 5.53 inches to thereby provide optimum smoothness of operation to the chair with minimum force and stroke.

14. The recline lift wall hugger chair of claim 7 wherein:

a. the lift means comprises:

i. a pair of laterally spaced vertical plates, each vertical plate being swingingly connected to the base by first and second swing arms; and ii. a cross brace extending between and joined to the vertical plates; and b. the power means comprises:

i. a pair of laterally spaced driver links, each driver link having a first end pivotally connected to a respective lift means vertical plate and a distal end;

ii. lever means extending between and joined to the driver links; and iii. linear actuator means pivotally secured between the lever means and the base, the linear actuator being selectively actuable in a first direction to rotate the lever means and driver links relative to the lift means vertical plates in a first direction until the distal ends of the driver links contact the lift means cross brace and are thereby prevented from further rotation in the first direction and continued actuation of the linear actuator in the first direction operates the chair in the lift mode, the linear actuator being selectively actuable in a second direction to rotate the driver link distal ends away from the lift means cross brace to thereby create a gap therebetween and operate the chair in the recline mode.

15. The recline lift wall hugger chair of claim 14 wherein:

a. the lift means further comprises a pair of side plates, each side plate being rigidly joined to a respective vertical plate for movement therewith, the side plates being in contact with the base when the chair is in the upright and reclined positions;

b. each driver link is pivotally connected to the respective lift means vertical plate by a means of a connection that is common with the means for connection of the associated second swing arm with the vertical plate;

c. the power means driver links cooperate with the lift means side plates and lift means cross brace to define a transfer point at which the driver links distal ends contact the lift means cross brace and the lift means side plates are in contact with the base; and d. actuation of the linear actuator in the first direction from the transfer point operates the chair in the lift mode, and actuation of the linear actuator in the second direction from the transfer point operates the chair in the recline mode.

16. The recline lift wall hugger chair of claim 7 wherein the recliner means further comprises:

a. a pair of front links, each front link having a first end pivotally connected to the lift means and a second end pivotally connected to a respective seat link;

b. a pair of back links, each back link having a first end pivotally connected to the lift means and a second end pivotally connected to a respective seat link, the back links cooperating with the associated front links and seat links and the lift means to form a pair of laterally spaced four-bar linkages; and c. control linkage means pivotally connected to the power means, lift means, and seat links for moving the four-bar linkages between the upright and reclined positions in response to actuation of the power means in the recline mode.

17. The recline lift wall hugger chair of claim 16 wherein the control linkage means comprises:

a. a pair of first control links, each first control link having a first end pivotally connected to the power means and a second end; and b. a pair of second control links, each second control link having a first end pivotally connected to the second end of a corresponding first control link and a second end pivotally connected to a corresponding seat link, each second control link being pivotally connected intermediate its first and second ends to the lift means, so that actuation of the power means in the recline mode causes the first and second control links to move the four-bar linkage between the upright and reclined positions.

18. The recline lift wall hugger chair of claim 16 wherein the recliner means further comprises footrest means pivotally connected between the seat links and the front links of the four-bar linkages for operation between an open condition and a closed condition in response to operation of the chair between the reclined position and the upright position, respectively.

19. The recline lift wall hugger chair of claim 18 wherein the footrest means comprises:

a. a first link having a first end pivotally connected to the four-bar linkage front link and a second end;

b. a second link having a first end pivotally connected to the second end of the four-bar linkage first link and a second end, the second link being pivotally connected intermediate its ends to the seat link;

c. the distance between the pivotal connection (B) of the four-bar linkage front link with the seat link and the pivotal connection (J) of the footrest means first link with the four-bar linkage front link is between approximately 4.00 inches and 4.80 inches; and d. the length (JK) between the pivotal connections of the footrest means first link is between approximately 4.28 inches and 5.43 inches, so that the footrest means first link is dimensioned in relation to the four-bar linkage to produce smooth opening and closing of the footrest means in response to operation of the chair in the recline mode.

20. The recline lift wall hugger chair of claim 16 wherein:

a. the length between the pivotal connections (AB) of the front link of the four-bar linkage is approximately 7.06 inches;

the back link of the four-bar linkage is approximately 5.57 inches;

c. the distance between the pivotal connection (A) of the front link with the lift means and the pivotal connection (C) of the back link with the lift means is approximately 10.20 inches in a direction generally parallel to the plane of the base; and d. the distance between the pivotal connection (B) of the front link with the seat link and the pivotal connection (D) of the back link with the seat link is approximately 8.00 inches, so that the four-bar linkage is dimensioned to minimize the force required to produce uniform motion of the seat frame and backrest.

21. The recline lift wall hugger chair of claim 20 wherein there is a distance in the direction generally perpendicular to the plane of the base of between approximately 1.50 inches and 1.70 inches between the pivotal connection (A) of the front link with the lift means and the pivotal connection (C) of the back link with the lift means.

22. The recline lift wall hugger chair of claim 7 wherein the top portion of the backrest moves away from the selected vertical surface when the power means actuates the recliner means in the recline mode.

23. In combination with a chair having a base; a seat frame with a backrest rigidly attached thereto, the backrest having a top portion locatable at a predetermined distance from a selected vertical surface; lift means for fastening to the seat frame; and first and second swing arm means having respective pivotal connections between the lift means and the base for moving the lift means between an upright position and a lift position, apparatus for moving the seat frame and backrest between the upright position and a reclined position while maintaining at least the predetermined distance between the backrest top portion and the selected vertical surface comprising:

a. a pair of laterally spaced four-bar linkages pivotally supported on the lift means, each four-bar linkage having a seat links fastened to the seat frame, the four-bar linkages being operable to move the seat frame and backrest between the upright and reclined positions while maintaining the predetermined distance between the backrest top portion and the vertical surface, the seat link and the seat frame being in an upwardly and forwardly location when in the reclined position relative to their respective locations when in the upright position;

b. power means pivotally secured between the lift means and the base for selectively operating the chair in a lift mode to move the lift means, seat frame, and backrest between the upright and lift positions and in a recline mode to move the seat links, seat frame, and backrest between the upright and reclined positions; and c. control linkage means pivotally connected between the power means and the four-bar linkages to move the four-bar linkages in response to operation of the power means in the recline mode.

24. The combination of claim 23 wherein the power means comprises:

a. driver link means pivotally connected to the lift means and having a common pivotal connection thereon with the first swing arm means for rotation in first and second directions relative to the lift means, rotation in the first direction being limited by contact between the driver link means and a selected member of the lift means, the drive link means being contactable with the lift means selected member when the lift means is in the upright position to define a transfer point; and b. linear actuator means pivotally secured to the base for selectively actuating to rotate the drive link means in the first and second directions, wherein actuation of the linear actuator means in the first direction from the transfer point operates the chair in the lift mode and actuation of the linear actuator means in the second direction from the transfer point operates the chair in the recline mode.

25. The combination of claim 24 wherein the control linkage means comprises:

a. a pair of first control links having respective first end pivotally connected to the driver link means and respective second ends; and b. a pair of second control links having respective first ends pivotally connected to the second ends of the associated first control links, and respective second ends pivotally connected to the associated seat links, each second control link being pivotally connected intermediate the first and second ends thereof to the lift means.

26. The combination of claim 25 wherein the control linkage means further comprises adjustment means interposed between the second ends of the respective second control links and the associated seat links for manually changing the distance between said links, thereby enabling the associated four-bar linkage to be moved from a position in which said seat is upright to a position in which said seat is reclined.

27. The combination of claim 25 further comprising:

a. a pair of first adjustment links having respective first ends pivotally connected to the second ends of the second control links and respective second ends;

b. a pair of second adjustment links having respective first ends pivotally connected to the seat links and respective second ends; and c. means for adjustably joining the second ends of the respective first and second adjustment links to enable the distance between the first ends of the first and second adjustment links to be varied and thereby enable movement of the four-bar linkage without actuation of the power means.

28. The combination of claim 24 wherein the driver link means comprises:

a. a pair of laterally spaced driver links having respective first ends pivotally connected to the lift means at common pivotal connections with the second swing arm means and respective distal ends, wherein rotation of the driver links in the first direction is limited by contact between the lift means selected member and the distal ends of the driver links to create a transfer point when the chair is in the upright position; and b. a brace extending between and joined to the driver links, the brace being pivotally connected to the linear actuator means.

29. The combination of claim 23 wherein the top portion of the backrest moves to a location at a distance from the selected vertical surface greater than the predetermined distance when the power means actuates the four-bar linkages to move the seat frame and backrest from the upright position to the reclined position.

* * * * *